US011807494B2

(12) United States Patent
Babu

(10) Patent No.: US 11,807,494 B2
(45) Date of Patent: Nov. 7, 2023

(54) LANDING LEVER ASSEMBLY OF A PNEUMATIC VACUUM ELEVATOR AND METHOD TO OPERATE THE SAME

(71) Applicant: Killalathu Ramanathan Babu, Tamilnadu (IN)

(72) Inventor: Killalathu Ramanathan Babu, Tamilnadu (IN)

(73) Assignee: Killakathu Ramanathan Babu (IN)

( * ) Notice: Subject to any disclaimer, the term of this patent is extended or adjusted under 35 U.S.C. 154(b) by 0 days.

(21) Appl. No.: 17/928,624

(22) PCT Filed: Sep. 11, 2020

(86) PCT No.: PCT/IB2020/058444

§ 371 (c)(1),
(2) Date: Nov. 30, 2022

(87) PCT Pub. No.: WO2021/245456

PCT Pub. Date: Dec. 9, 2021

(65) Prior Publication Data

US 2023/0137945 A1 May 4, 2023

(30) Foreign Application Priority Data

Jun. 2, 2020 (IN) ..... 202041023083

(51) Int. Cl.
*B66B 1/36* (2006.01)
*B66B 9/04* (2006.01)

(52) U.S. Cl.
CPC ..... *B66B 1/365* (2013.01); *B66B 9/04* (2013.01)

(58) Field of Classification Search
CPC ..... B66B 1/365; B66B 9/04; B66B 17/34
See application file for complete search history.

(56) References Cited

U.S. PATENT DOCUMENTS 5,447,211 A * 9/1995 Sors ..... B66B 9/04 187/277
5,583,326 A * 12/1996 Sors ..... B66B 9/04 187/277
6,085,873 A * 7/2000 Macchi ..... B66B 9/04 187/400

FOREIGN PATENT DOCUMENTS

| | | |
|---|---|---|
| CN | 104401851 B | 2/2017 |
| EP | 0550904 B1 | 8/1996 |
| KR | 101160644 B1 | 6/2012 |

* cited by examiner

*Primary Examiner* — Jeffrey Donels
(74) *Attorney, Agent, or Firm* — Jason C. Cameron

(57) ABSTRACT

A landing lever assembly of a pneumatic vacuum elevator is disclosed. The assembly includes a landing lever plate coupled on a roof of an elevator cabin. The assembly also includes a locking plate coupled to the landing lever plate using a plurality of support plates. The assembly further includes a solenoid valve disposed on the landing lever plate and mechanically coupled to the locking plate using a guide pin, where the guide pin is configured to actuate the locking plate by sliding within the solenoid valve, in at least one operational mode, based on an activation signal received from a magnetic sensor.

8 Claims, 7 Drawing Sheets

3(a)

3(b)

LANDING LEVER ASSEMBLY OF A PNEUMATIC VACUUM ELEVATOR AND METHOD TO OPERATE THE SAME

CROSS-REFERENCE TO RELATED APPLICATION

This Application claims priority from a Patent application filed in India having Patent Application No. 202041023083, filed on Jun. 2, 2020, and titled "LANDING LEVER ASSEMBLY OF A PNEUMATIC VACUUM ELEVATOR AND METHOD TO OPERATE THE SAME" and a PCT Application No. PCT/IB2020/058444 filed on Sep. 11, 2020, and titled "LANDING LEVER ASSEMBLY OF A PNEUMATIC VACUUM ELEVATOR AND METHOD TO OPERATE THE SAME".

BACKGROUND

Embodiment of the present disclosure relates to a pneumatic vacuum elevator and more particularly to a landing lever assembly of a pneumatic vacuum elevator.

In elevators, the elevator cabin is arranged to travel up and down in an elevator hoist way, which is normally an enclosed space. The new elevator technologies allowing brakes to generate a risk of drifting the elevator cabin stopping at a floor landing, especially at the time of loading and unloading the elevator cabin. However, such phenomenon is the origin of accidents. Indeed, when stopping the elevator cabin at a floor landing a large number of mechanical elements of the elevator participates in the immobilization of the cabin, the brake or the like. However, only one faulty element of among various parts causes the drift of the cabin, to down or up, depending on its load or during loading or unloading.

Conventionally, if the electromagnetic brake is abnormal for some reason and the braking force is insufficient after the elevator cabin has landed, the elevator cabin will not be able to be held. For example, if there are no passengers in the elevator cabin, the elevator cabin is pulled by the counterweight, whereas the elevator cabin door and the landing door rises with the door open. As a result, the landing is detected by the position detecting device, when the elevator cabin is started. In such situation, the braking force of the electromagnetic brake is reduced. In the state of shortage, it is impossible to hold the elevator cabin with the electromagnetic brake and the elevator cabin will not be able to stay stopped even if passengers try to get off the car.

Hence, there is a need for an improved landing lever assembly to address the aforementioned issue(s).

BRIEF DESCRIPTION

In accordance with an embodiment of the present disclosure, a landing lever assembly of a pneumatic vacuum elevator is provided. The assembly includes a landing lever plate coupled on a roof of an elevator cabin. The assembly also includes a locking plate coupled to the landing lever plate using a plurality of support plates. The assembly further includes a solenoid valve disposed on the landing lever plate and mechanically coupled to the locking plate using a guide pin, where the guide pin is configured to actuate the locking plate by sliding within the solenoid valve, in at least one operational mode, based on an activation signal received from a magnetic sensor.

In accordance with another embodiment of the present disclosure, a method to operate the landing lever assembly is provided. The method includes providing a locking plate coupled to a landing lever plate using a plurality of support plates. The method also includes providing a solenoid valve disposed on the landing lever plate and mechanically coupled to the locking plate using a guide pin. The method further includes actuating the locking plate by sliding the guide pin within the solenoid valve, in at least one operational mode, based on an activation signal received from a magnetic sensor.

In accordance with yet another embodiment of the present disclosure, a pneumatic vacuum elevator is provided. The elevator includes an elevator cabin configured to carry one or more users between one or more levels of a structure. The elevator also includes a landing lever assembly mechanically coupled to the elevator cabin. The landing lever assembly includes a landing lever plate coupled on a roof of the elevator cabin. The assembly includes a locking plate coupled to the landing lever plate using a plurality of support plates. The assembly includes a solenoid valve disposed on the landing lever plate and mechanically coupled to the locking plate using a guide pin. The guide pin is configured to actuate the locking plate by sliding within the solenoid valve, in at least one operational mode, based on an activation signal received from a magnetic sensor.

To further clarify the advantages and features of the present disclosure, a more particular description of the disclosure will follow by reference to specific embodiments thereof, which are illustrated in the appended figures. It is to be appreciated that these figures depict only typical embodiments of the disclosure and are therefore not to be considered limiting in scope. The disclosure will be described and explained with additional specificity and detail with the appended figures.

BRIEF DESCRIPTION OF THE DRAWINGS

The disclosure will be described and explained with additional specificity and detail with the accompanying figures in which.

Figure 1:
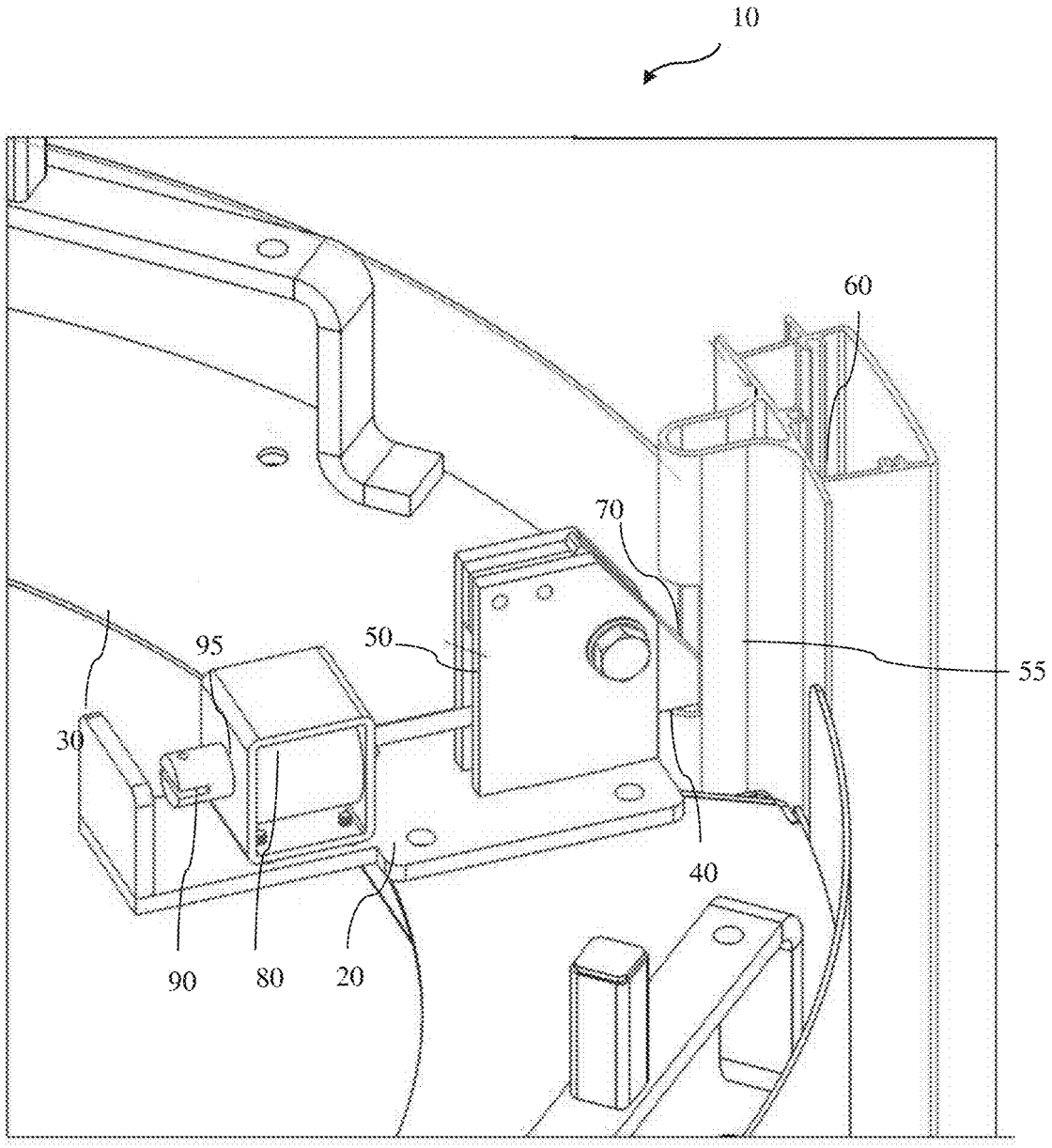
FIG. 1 is a schematic representation of a landing lever assembly of a pneumatic vacuum elevator in accordance with an embodiment of the present disclosure.

Further, those skilled in the art will appreciate that elements in the figures are illustrated for simplicity and may not have necessarily been drawn to scale. Furthermore, in terms of the construction of the device, one or more components of the device may have been represented in the figures by conventional symbols, and the figures may show only those specific details that are pertinent to understanding the embodiments of the present disclosure so as not to obscure the figures with details that will be readily apparent to those skilled in the art having the benefit of the description herein.

DETAILED DESCRIPTION

For the purpose of promoting an understanding of the principles of the disclosure, reference will now be made to the embodiment illustrated in the figures and specific language will be used to describe them. It will nevertheless be understood that no limitation of the scope of the disclosure is thereby intended. Such alterations and further modifications in the illustrated system, and such further applications of the principles of the disclosure as would normally occur to those skilled in the art are to be construed as being within the scope of the present disclosure.

The terms "comprises", "comprising", or any other variations thereof, are intended to cover a non-exclusive inclusion, such that a process or method that comprises a list of steps does not include only those steps but may include other steps not expressly listed or inherent to such a process or method. Similarly, one or more devices or sub-systems or elements or structures or components preceded by "comprises . . . a" does not, without more constraints, preclude the existence of other devices, sub-systems, elements, structures, components, additional devices, additional sub-systems, additional elements, additional structures or additional components. Appearances of the phrase "in an embodiment", "in another embodiment" and similar language throughout this specification may, but not necessarily do, all refer to the same embodiment.

Unless otherwise defined, all technical and scientific terms used herein have the same meaning as commonly understood by those skilled in the art to which this disclosure belongs. The system, methods, and examples provided herein are only illustrative and not intended to be limiting.

In the following specification and the claims, reference will be made to a number of terms, which shall be defined to have the following meanings. The singular forms "a", "an", and "the" include plural references unless the context clearly dictates otherwise.

Embodiments of the present disclosure relates to a landing lever assembly of a pneumatic vacuum elevator and a method to operate the same. The assembly includes a landing lever plate coupled on a roof of an elevator cabin. The assembly also includes a locking plate coupled to the landing lever plate using a plurality of support plates. The assembly further includes a solenoid valve disposed on the landing lever plate and mechanically coupled to the locking plate using a guide pin, where the guide pin is configured to actuate the locking plate by sliding within the solenoid valve, in at least one operational mode, based on an activation signal received from a magnetic sensor.

FIG. 1 is a schematic representation of a landing lever assembly 10 of a pneumatic vacuum elevator in accordance with an embodiment of the present disclosure. The landing lever assembly 10 includes a landing lever plate 20 mechanically coupled to a roof of an elevator cabin 30. As used herein, the landing lever plate 20 is a base plate of the assembly 10, where the assembly 10 is arranged on the landing lever plate 20 to lock the elevator cabin 30 in a pneumatic vacuum elevator cylinder. Further, the assembly 10 includes a locking plate 40 mechanically coupled to the landing lever plate 20 using support plates 50. In one embodiment, the locking plate 40 may include a triangular shape. In a specific embodiment, the locking plate 40 may be composed of metal. In one embodiment, the locking plate 40 may be rested on a guide rail 55 in an elevator cylinder assembly 60 via a cut-out 70. As used herein, the locking plate 40 is provided to support the elevator cabin 30 independently of the hoisting mechanism while the load transfer is being affected. The locking plate 40 prevents the elevator cabin 30 descending when the brake does not hold, the power is insufficient or, in case of traction elevators, when the traction is insufficient.

Furthermore, the assembly 10 includes a solenoid valve 80, where bottom side of the solenoidal valve 80 is disposed on the landing lever plate 20. The solenoid valve 80 includes a hollow portion which is adapted to receive a guide pin 90 via two holes 95 on each side of the solenoid valve 80. In one embodiment, the solenoid valve 80 may use power to engage the locking plate 40. The locking plate 40 does not require power to have it released. The locking plate 40 is mechanically coupled to the solenoid valve 80 using the guide pin 90. In one embodiment, the solenoid valve 80 and the guide pin 90 may be composed of metal. The guide pin 90 actuates the locking plate 40 by sliding within the solenoid valve 80, in at least one mode, based on an activation signal received from a magnetic sensor (not shown in FIG. 1). In one embodiment, the magnetic sensor is coupled to the guide pin 90, where the magnetic sensor is placed on an external cylinder at each landing position. In a specific embodiment, the at least one operational mode may include a lock applied condition or a lock released condition. In details, when the magnetic sensor sends the landing position of the elevator cabin 30, the magnetic sensor sends the activation signal to the guide pin 90. As a result, the guide pin 90 slides within the solenoid valve 80 and actuate the locking plate 40 in at least one direction depending upon the action of the elevator cabin 30 to lock or release the elevator cabin 30 with the guide rail 55.

Figure 2:
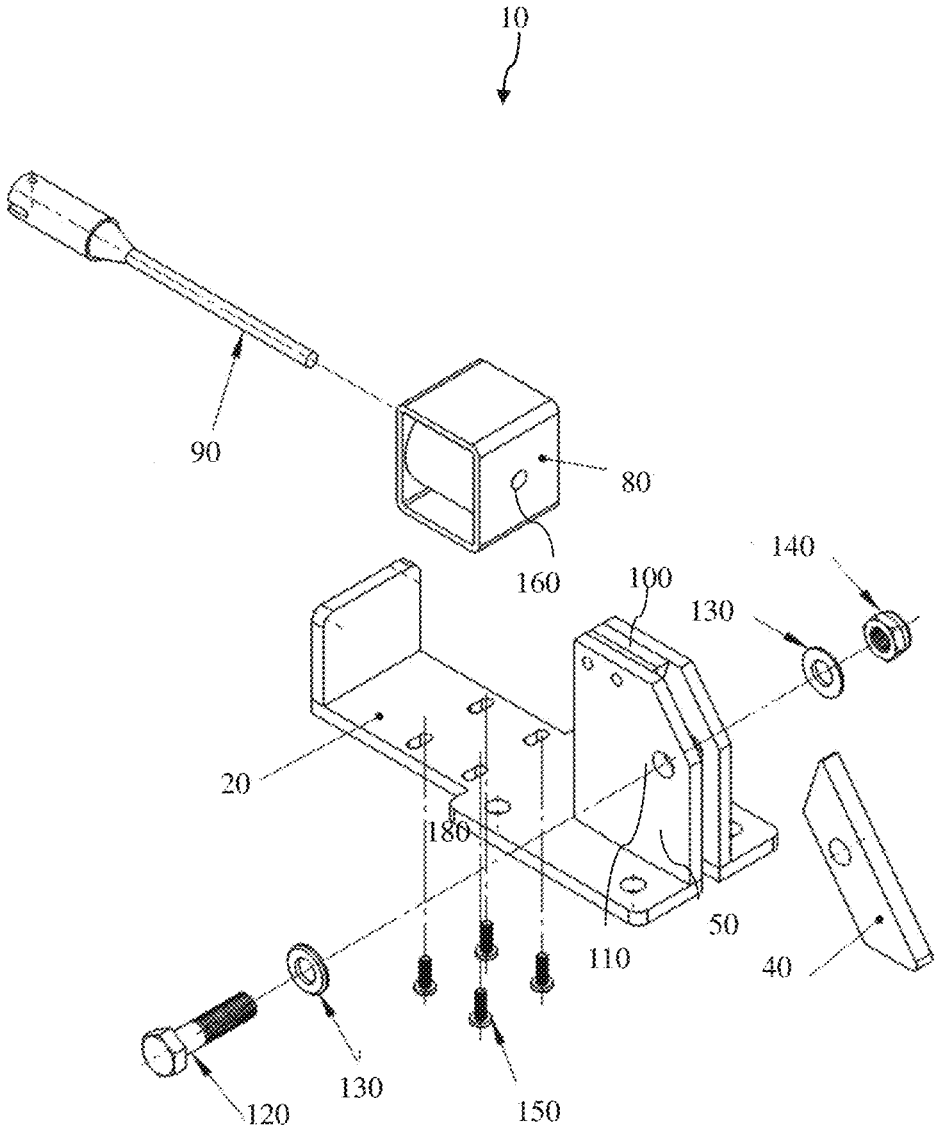
FIG. 2 is a schematic representation of an exploded view of landing lever assembly of FIG. 1, depicting position of various components in the landing lever assembly in accordance with an embodiment of the present disclosure.

FIG. 2 is a schematic representation of an exploded view of the landing lever assembly 10 of FIG. 1, depicting position of various components in the landing lever assembly 10 in accordance with an embodiment of the present disclosure. The landing lever assembly 10 includes the landing lever plate 20 which act as a base for the assembly 10. The assembly 10 also includes support plates 50. In an exemplary embodiment, the support plates 50 may two support plates. In one embodiment, the support plates 50 are coupled together using at least two intermediate plates 100, where the at least two intermediate plates 100 are arranged in between the two support plates 50. Each of the support plate 50 includes a hole 110. The assembly 10 also includes the locking plate 40 which is coupled to the support plates 50 using a hex bolt 120, at least two washers 130 and a locking nut 140 passed through the holes 110 of the support plates 50. In such an embodiment, the locknut 130 may include a hex nyloc nut. As used herein, the nyloc nut may include a nylon-insert lock nut, polymer-insert lock nut, or elastic stop nut. The nyloc nut is a kind of locknut with a nylon collar that increases friction on the screw thread.

In addition, the assembly 10 includes the solenoid valve 80 which is coupled to the bottom of the landing lever plate 20 using multiple screws 150. In a specific embodiment, the solenoid valve 50 may be coupled to the landing lever plate 20 using four pan head screws. As used herein, the pan head screws are machine screws with heads that are flat on top and rounded on the sides. The solenoid valve 80 includes two holes 160 on each on left and right side of the solenoid valve 80. The two holes 160 are adapted to receive the guide pin 90. The guide pin 90 may slide within the solenoid valve 80 based on the activation signal received from the magnetic sensor. One end of the guide pin 90 is coupled to the locking plate 40. The guide pin 90 slides within the solenoid valve 80 upon receiving the activation signal to actuate the locking plate 40 to control the movement of the elevator cabin 30.

Figure 3:
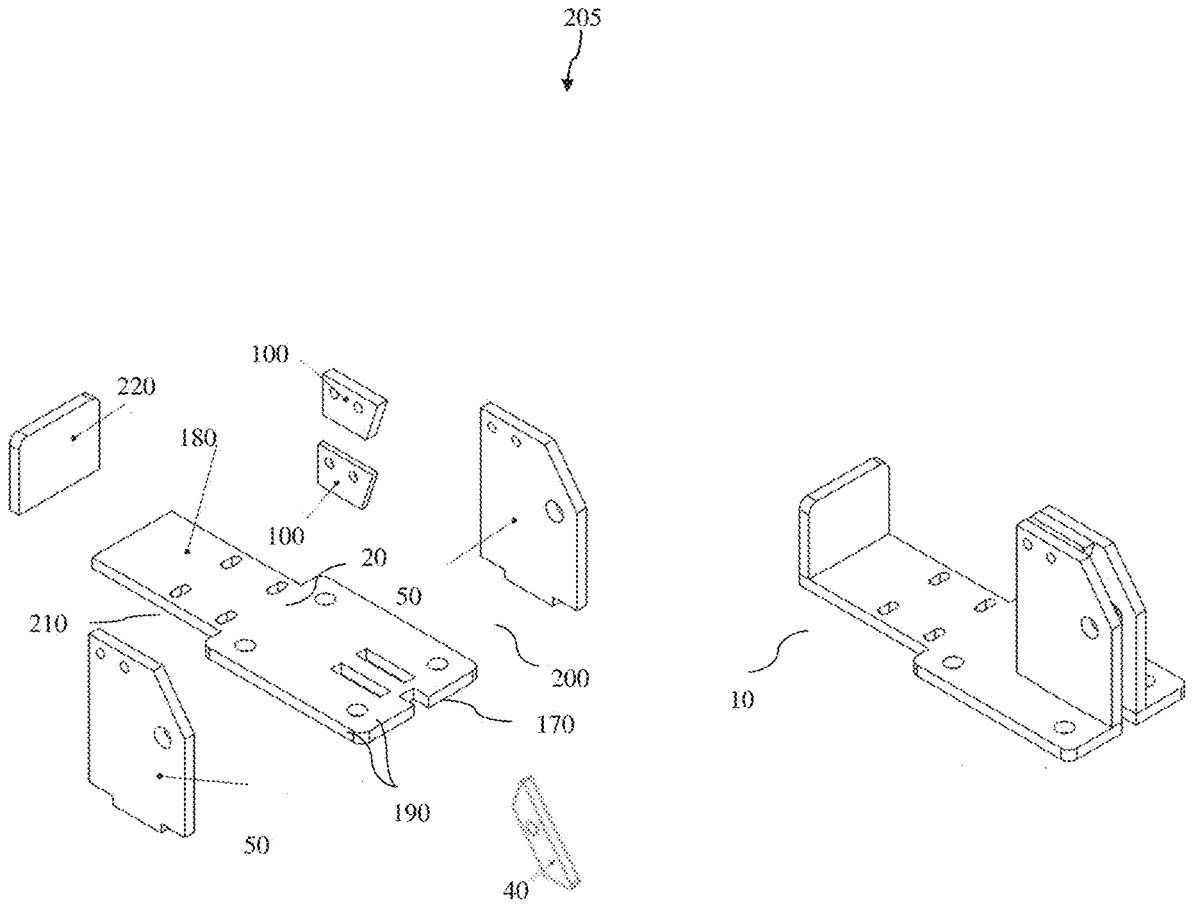
FIG. 3 is a schematic representation of one embodiment of the landing lever assembly of FIG. 1 in accordance with an embodiment of the present disclosure.

FIG. 3 is a schematic representation of one embodiment 205 of the landing lever assembly 10 of FIG. 1 in accordance with an embodiment of the present disclosure. FIG. 3(*a*) shows an exploded view of landing lever plate weldment with aligning position and FIG. 3(*b*) shows an assembled view of landing lever plate weldment with fixed position. The assembly 10 includes a landing lever plate 20, where the landing lever plate 20 includes a first portion 170 and a second portion 180. The first portion 170 is broader than the second portion 180. The first portion 180 includes two slots 190 of a first predefined size. The assembly 10 also includes two support plates 50, where each of the support plate 50 includes a protrusion 200. The two slots 190 of the landing lever plate 20 are adapted to receive respectively protrusions 200 of the support plates 50. The two support plates 50 accommodate at least two intermediate plates 100 to create a spacing between the two support plates 50. The spacing between the two support plates 50 enable the locking plate 40 to move in predefined directions.

Subsequently, the second portion 180 of the landing lever plate 20 includes four slots 210 of a second predefined size. The assembly 10 includes the solenoid valve 80 which is fixed in the four slots 210 of the landing lever plate 20. The second portion 180 of the landing lever plate 20 includes a side plate 220 which is coupled at the end of the landing lever plate 20.

Figure 4:
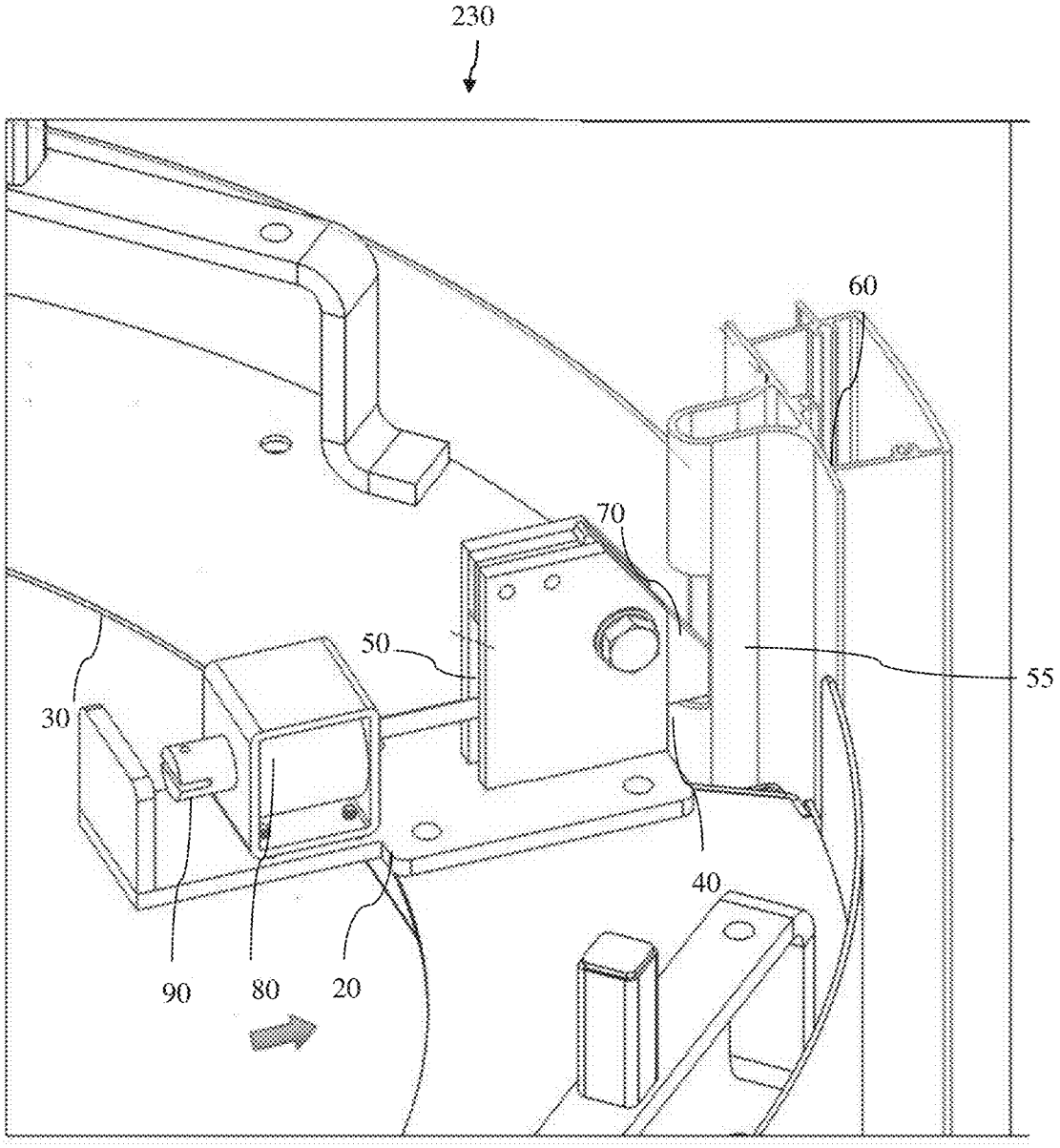
FIG. 4 is a schematic representation of functional view of the landing lever assembly of FIG. 1, depicting operation of the landing lever assembly in locking condition in accordance with an embodiment of the present disclosure.

FIG. 4 is a schematic representation of functional view 230 of the landing lever assembly 10 of FIG. 1, depicting operation of the landing lever assembly 10 in locking condition in accordance with an embodiment of the present disclosure. During the movement of the elevator cabin 30, if the elevator cabin 30 is stopped at any floor landing, then the magnetic sensor senses this condition and generates the activation signal. The activation signal is provided to the guide pin 90 which slides within the solenoid valve 80 in a forward direction. The movement of the guide pin 90 in the forward direction actuates the locking plate 40 in a forward direction which then rest on the cut-out 70 of the guide rail 55 in the elevator cylinder assembly 75 and lock the elevator cabin 30.

Figure 5:
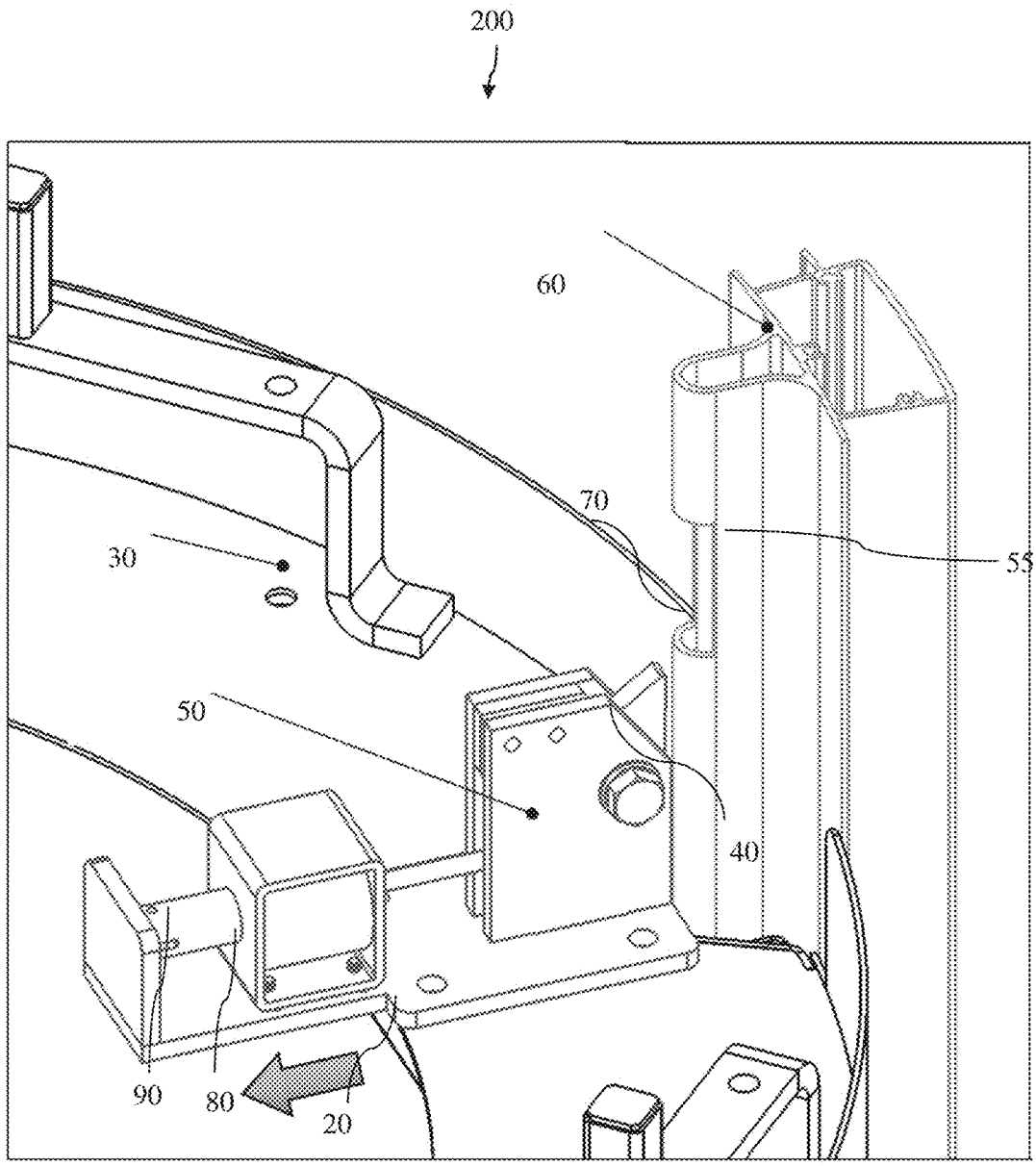
FIG. 5 is a schematic representation of functional view of the landing lever assembly of FIG. 1, depicting operation of the landing lever assembly in unlocking condition in accordance with an embodiment of the present disclosure.

FIG. 5 is a schematic representation of functional view 250 of the landing lever assembly 10 of FIG. 1, depicting operation of the landing lever assembly 10 in unlocking condition in accordance with an embodiment of the present disclosure. When the elevator cabin 30 is started moving from any floor landing, then the magnetic sensor senses this condition and generates the activation signal. The activation signal is provided to the guide pin 90 which slides within the solenoid valve 80 in a backward direction. The movement of the guide pin 90 in the backward direction actuates the locking plate 40 in a backward direction which then removed from the cut-out 70 of the guide rail 55 in the elevator cylinder assembly 75 and release the elevator cabin 30.

Figure 6:
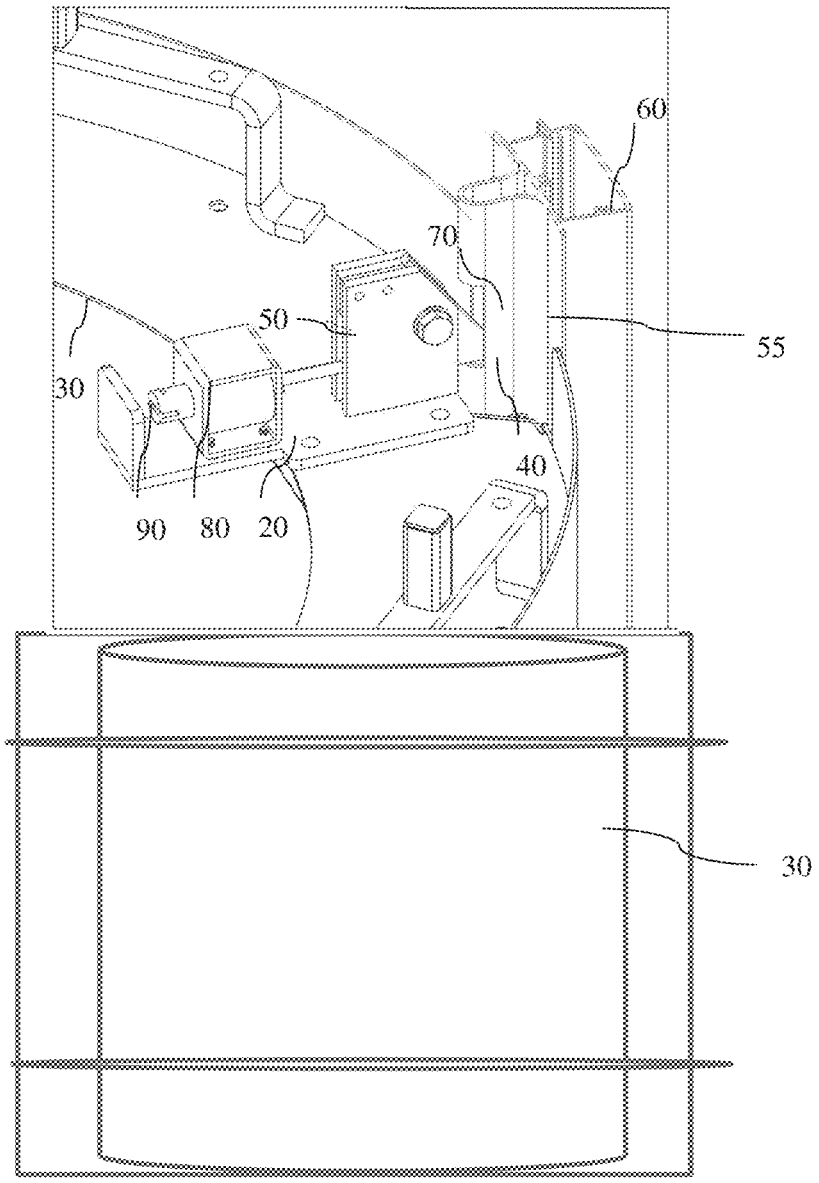
FIG. 6 is a schematic representation of pneumatic vacuum elevator in accordance with an embodiment of the present disclosure.

FIG. 6 is a schematic representation of the pneumatic vacuum elevator 260 in accordance with an embodiment of the present disclosure. The pneumatic vacuum elevator 260 includes an elevator cabin 30 to carry one or more users between one or more levels of a stricture. In one embodiment, the structure may include building, vessel or the like. The elevator 260 also includes a landing lever assembly 10 mechanically coupled to the elevator cabin 30. The landing lever assembly 10 includes a landing lever plate 20 coupled on a roof of an elevator cabin 30. The assembly 10 also includes a locking plate 40 coupled to the landing lever plate 20 using support plates 50. The assembly 10 further includes a solenoid valve 80 disposed on the landing lever plate 20 and mechanically coupled to the locking plate 40 using a guide pin 90, where the guide pin 90 actuates the locking plate 40 by sliding within the solenoid valve 80, in at least one operational mode, based on an activation signal received from a magnetic sensor.

Figure 7:
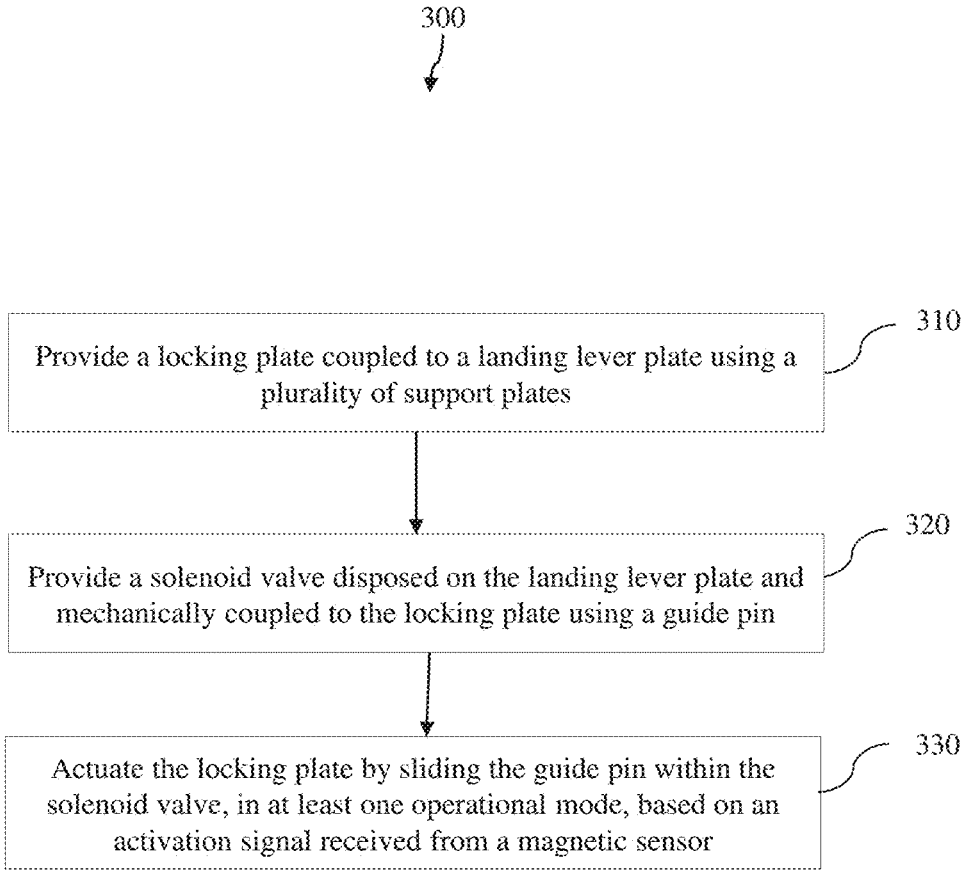
FIG. 7 is a flow chart representing the steps involved in a method for operating the landing lever assembly of the pneumatic vacuum elevator in accordance with an embodiment of the present disclosure.

FIG. 7 is a flow chart representing the steps involved in method 300 for operating the landing lever assembly in accordance with an embodiment of the present disclosure. The method 300 includes providing a locking plate coupled to a landing lever plate using support plates in step 310. In one embodiment, the support plates may be coupled to the landing lever plate using at least two intermediate plates arranged in between the support plates. In such embodiment, the locking plate may be coupled to the support plates using a hex bolt, at least two washers and a locking nut.

The method 300 also includes providing a solenoid valve disposed on the landing lever plate and mechanically coupled to the locking plate using a guide pin in step 320. In one embodiment, the solenoid valve is coupled to the landing lever plate using screws. The solenoid valve includes two holes on each on left and right side of the solenoid valve. The two holes are adapted to receive the guide pin. In such an embodiment, the guide pin and the solenoid valve may be composed of metal.

Furthermore, the method 300 includes actuating the locking plate by sliding the guide pin within the solenoid valve, in at least one operational mode, based on an activation signal received from a magnetic sensor in step 330. In a specific embodiment, the at least one operational mode may include a lock applied condition or a lock released condition. In one embodiment, actuating the locking plate may include actuating the locking plate in a forward direction by sliding the guide pin in the forward direction based on an activation signal received from a magnetic sensor. In another embodiment, actuating the locking plate may include actuating the locking plate in a backward direction by sliding the guide pin in the backward direction based on an activation signal received from a magnetic sensor.

Various embodiments of the landing lever assembly as described above enables safety lock for an enclosed pneumatic vacuum elevator cabin provides a simple mechanism for setting the elevator landing door safety locking plate. The landing lever assembly allows control over the energy supplied to the motor and so enabled the elevator to be accurately positioned It will be understood by those skilled in the art that the foregoing general description and the following detailed description are exemplary and explanatory of the disclosure and are not intended to be restrictive thereof.

While specific language has been used to describe the disclosure, any limitations arising on account of the same are not intended. As would be apparent to a person skilled in the art, various working modifications may be made to the method 250 in order to implement the inventive concept as taught herein.

The figures and the foregoing description give examples of embodiments. Those skilled in the art will appreciate that one or more of the described elements may well be combined into a single functional element. Alternatively, certain elements may be split into multiple functional elements.

Elements from one embodiment may be added to another embodiment. For example, order of processes described herein may be changed and are not limited to the manner described herein. Moreover, the actions of any flow diagram need not be implemented in the order shown; nor do all of the acts need to be necessarily performed. Also, those acts that are not dependent on other acts may be performed in parallel with the other acts. The scope of embodiments is by no means limited by these specific examples.

I claim:

1. A landing lever assembly of a pneumatic vacuum elevator comprising:

a landing lever plate coupled on a roof of an elevator cabin;

a locking plate coupled to the landing lever plate using a plurality of support plates; and a solenoid valve disposed on the landing lever plate and mechanically coupled to the locking plate using a guide pin, wherein the guide pin is configured to actuate the locking plate in at least one operational mode, wherein the at least one operational mode comprises:

actuating the locking plate in a forward direction by sliding the guide pin in the forward direction based on an activation signal received from a magnetic sensor; and actuating the locking plate in a backward direction by sliding the guide pin in the backward direction based on an activation signal received from a magnetic sensor.

2. The assembly as claimed in claim 1, wherein the locking plate is rested on a guide rail in an elevator cylinder assembly via a cut-out.

3. The assembly as claimed in claim 1, wherein the magnetic sensor is coupled to the guide pin, wherein the magnetic sensor is placed on the elevator cylinder assembly at each landing position.

4. The assembly as claimed in claim 1, wherein the locking plate is coupled to the plurality of support plates using a hex bolt, at least two washers and a locking nut.

5. The assembly as claimed in claim 1, wherein the solenoid valve is coupled to the landing lever plate using a plurality of screws.

6. The assembly as claimed in claim 1, wherein the solenoid valve require power to engage the locking plate during locking operation, wherein the power is unneeded for unlocking operation.

7. A method comprising:

providing a locking plate coupled to a landing lever plate using a plurality of support plates;

providing a solenoid valve disposed on the landing lever plate and mechanically coupled to the locking plate using a guide pin; and actuating the locking plate, in at least one operational mode, wherein actuating the locking plate in the at least one mode comprises:

actuating the locking plate in a forward direction by sliding the guide pin in the forward direction based on an activation signal received from a magnetic sensor;

actuating the locking plate in a backward direction by sliding the guide pin in the backward direction based on an activation signal received from a magnetic sensor.

8. A pneumatic vacuum elevator comprising:

an elevator cabin configured to carry one or more users between one or more levels of a structure; and a landing lever assembly mechanically coupled to the elevator cabin, wherein the landing lever assembly comprises:

a landing lever plate coupled on a roof of the elevator cabin;

a locking plate coupled to the landing lever plate using a plurality of support plates; and a solenoid valve disposed on the landing lever plate and mechanically coupled to the locking plate using a guide pin, wherein the guide pin is configured to actuate the locking plate, in at least one operational mode, wherein the at least one operational mode comprises:

actuating the locking plate in a forward direction by sliding the guide pin in the forward direction based on an activation signal received from a magnetic sensor; and actuating the locking plate in a backward direction by sliding the guide pin in the backward direction based on an activation signal received from a magnetic sensor.

* * * * *